United States Patent [19]

Hartler et al.

[11] Patent Number: 4,690,731

[45] Date of Patent: Sep. 1, 1987

[54] METHOD OF MAKING SULPHATE PULP

[75] Inventors: Nils J. C. Hartler, Lidingö ; Karl-Erik Lekander, Alingsås; Lars T. Sjödin, Solna; Per J. Mjöberg, Ekerö, all of Sweden

[73] Assignee: Sunds Defibrator Aktiebolag, Sweden

[21] Appl. No.: 784,707

[22] Filed: Oct. 4, 1985

Related U.S. Application Data

[63] Continuation of Ser. No. 482,879, Apr. 7, 1983, abandoned.

[30] Foreign Application Priority Data

Apr. 28, 1982 [SE] Sweden ..... 8202665

[51] Int. Cl.[4] ..... D21C 3/26; D21C 11/00

[52] U.S. Cl. ..... 162/45; 162/39; 162/60; 162/82; 162/86

[58] Field of Search ..... 162/19, 42, 249, 62, 162/60, 43, 47, 44, 250, 61, 45, 90, 38, 39, 82, 84, 86; 210/196, 262, 415

[56] References Cited

U.S. PATENT DOCUMENTS

| | | | |
|---|---|---|---|
| 1,645,754 | 10/1927 | Howell, Jr. | 162/249 |
| 1,816,343 | 7/1931 | Richter | 162/90 |
| 2,041,597 | 5/1936 | Dunbar | 162/249 |
| 2,195,378 | 3/1940 | Dunbar | 162/60 |
| 2,849,315 | 8/1958 | Haglund | 162/42 |
| 3,294,623 | 12/1966 | Brinkley, Jr. et al. | 162/60 |
| 3,313,677 | 4/1967 | Carr | 162/61 |
| 3,467,573 | 9/1969 | Vogel | 162/60 |
| 4,236,961 | 12/1980 | Green | 162/241 |

FOREIGN PATENT DOCUMENTS 1354383 1/1964 France .

OTHER PUBLICATIONS

Modified Kraft Processes for Softwood Bleached--Grade Pulp, Tappi, Jul. 1979, pp. 49-51.

*Primary Examiner*—Steve Alvo

*Attorney, Agent, or Firm*—Lerner, David, Littenberg, Krumholz & Mentlik

[57] ABSTRACT

A modified batch cooking technique for making sulfate pulp with a high degree of delignification or with a normal degree of delignification but with increased pulp viscosity. This is effected by one or several displacements of the liquor in the digester with liquor of the same temperature as the cooking liquor but with a lower lignin content.

1 Claim, 2 Drawing Figures

METHOD OF MAKING SULPHATE PULP

This is a continuation of application Ser. No. 06/482,879 filed Apr. 7, 1983, now abandoned.

BACKGROUND OF THE INVENTION

This invention relates to a method of making sulfate pulp. More particularly, the invention relates to a delignification by delignifying in batch digesters.

In making sulfate pulp for bleaching, at present the cooking is interrupted at kappa number 30–35. A continued delignification in the charge to the kappa number range 20–25 could be of interest as an alternative, for example, to oxygen bleaching, for reducing the discharge. An extension of the sulfate cooking, however, involves certain problems, expecially in respect of pulp yield and pulp viscosity.

SUMMARY OF THE INVENTION

Investigations carried out have proved, that during the cooking three parameters are especially important for obtaining good viscosity values. These parameters are the concentration profiles for effective alkali, for the hydrogen sulfide ions and for the solved lignin. For obtaining high viscosity, it must be tried during the cooking (1) to have a concentration of effective alkali as low and as uniform as possible, (2) to have the highest possible hydrogen sulfide ion concentration at the transition from the initial phase to bulk phase, and (3) to have a concentration of solved lignin as low as possible toward later parts of the cooking.

The first item can to a certain extent be realized by employing divided white liquor charges during the cooking. The second item is more difficult to realize, because the white liquor holds a certain sulfidity, and the sulfide concentration cannot be varied independently of the alkali concentration. The third item can be realized by carrying out cooking liquor exchanges ("cooking liquor recyclings") in order in this way to pass the solved lignin to previous stages of the cooking, which exchanges are carried out in batch cookings.

The present invention is directed to a method of making sulfate pulp with a high degree of delignification from lignocellulose material in batch digesters. In the process, at least one displacement of substantially the free liquor in the digester is carried out with a washing liquor of the same temperature as the cooking liquor but with lower lignin content. This is performed by using in the displacement a washing liquor, which was heat exchanged to digester temperature.

In a preferred embodiment of the invention, repeated displacement of substantially the free liquor in the digester is carried out with the liquor of the same temperature as the cooking liquor but with lower lignin content. This is performed by using in the last displacement a washing liquor, which was heat exchanged to digester temperature. In the next to last displacement, displacement liquor from the last displacement is employed, etc. Continuous liquor flow and periodic change between the different digesters can be performed depending upon their position in the cooking cycle.

DETAILED DESCRIPTION OF THE INVENTION

In the following, batch cooking methods with one and two cooking liquor exchanges are proposed for being able either to cook to kappa numbers in the range 20–25, or to cook to kappa numbers in the range 30–35 with raised viscosity level.

One Liquor Exchange

Figure 1:
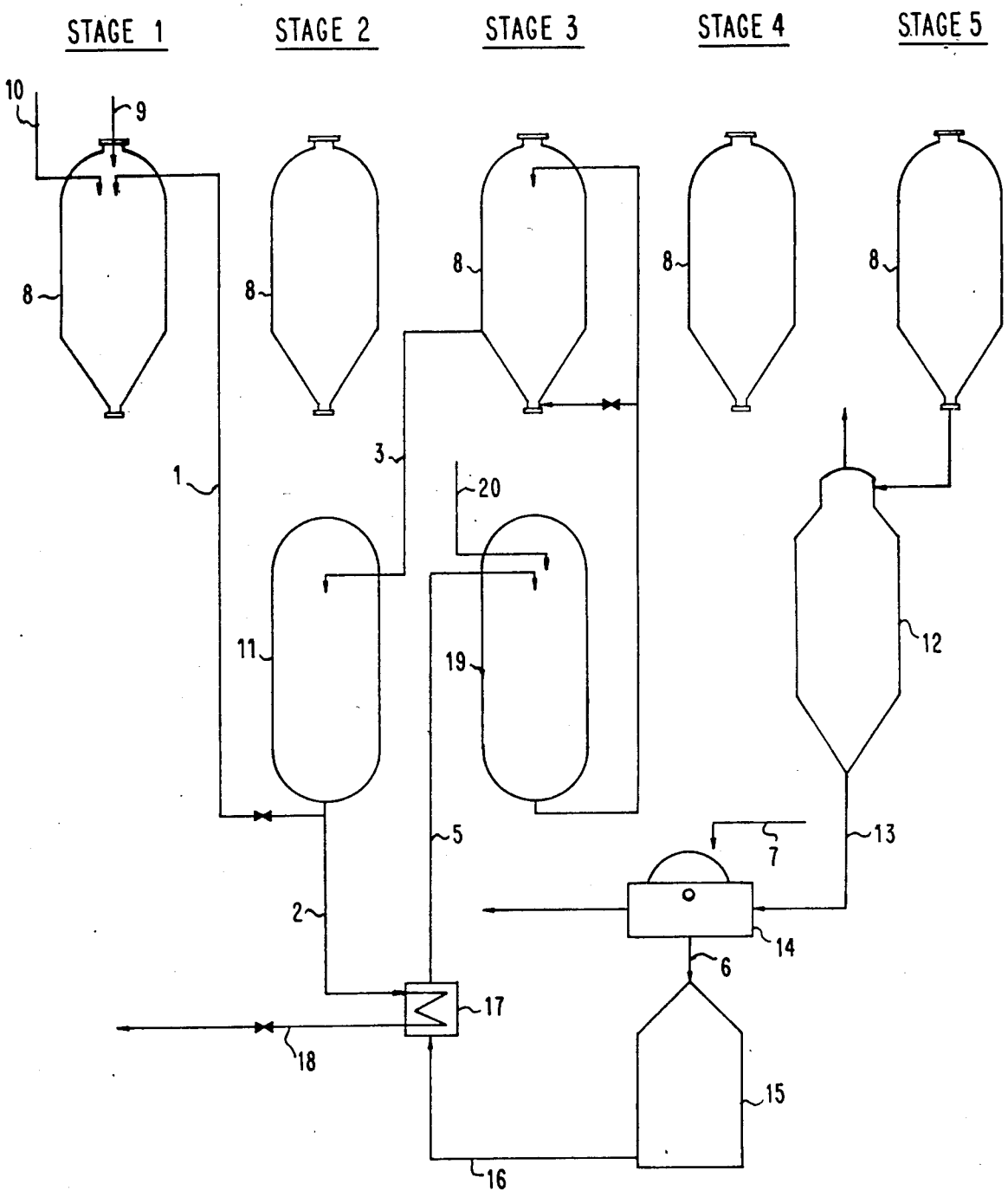
FIG. 1 is a block diagram for a batch cooking process in accordance with the present invention with one liquor exchange.

The basic layout for batch cooking with one liquor exchange is shown in FIG. 1 to provide increased selectivity in delignification. FIG. 1 shows a flow chart (block diagram) for batch cooking by using the method according to the invention.

FIG. 1 shows a digester in different stages (1–5) of the cooking cycle. In stage 1, chips are filled and liquor is charged into the digester. In stage 2, cooking phase 1 is performed. In stage 3, displacement of strong liquor takes place. In stage 4, the second cooking phase is performed, and in stage 5, blowing is performed.

At the beginning of the cooking, the digester 8 is charged with wood via line 9 and white liquor via line 10 and also with a certain amount of strong black liquor (via flow 1) from the strong liquor tank 11 at 170° C. After completed cooking, blowing is carried out to the blow tank 12 (stage 5) at 100° C., from which the pulp is pumped via line 13 to the pulp washing plant 14, where the pulp is washed with washing liquor (via flow 7). The filtrate is collected via line 6 in washing filtrate tanks 15, from which it is pumped via line 16 through a heat exchanger 17 and heat exchanged against strong liquor at 170° C., which is passed via line 18 at 90° C. to evaporation. The washing filtrate thus heated is collected via line 5 in the so-called weak liquor accumulator 19 and is there additionally slightly heated to full cooking temperature of 170° C. In this accumulator 19, the composition of the liquor is also adjusted by the addition via line 20 of white liquor intended for cooking phase 2. According to the invention, the cooking liquor is displaced in the digester, which has passed through cooking phase 1, in stage 3 according to FIG. 1 by weak liquor supplied through digester flow 4. The displaced strong liquor is removed from the digester through a conduit 3 and passed to the strong liquor accumulator 11. After the displacement, the cooking then occurs during phase 2.

In Table 1 below theoretical calculations for four different cases with cooking liquor exchanges at different occasions (yields) are shown as examples. During phase 1 and 2 the liquor-wood ratio is held equal to 4.0. In all calculations examples, the final kappa number has been assumed to be 25.

TABLE 1

Calculated lignin concentrations in different phases of the cooking at modified batch cooking with one liquor exchange. The calculations are based on the supply of 4.75 $m^3$ washing liquor per metric ton pulp and pulp dry content after washing of 33%. The liquor-wood ratio is held in the calculations equal to 4.0 $m^3$/metric ton.

| Yield (% of wood) | | | | Lignin concentrations (g/l) | | | |
|---|---|---|---|---|---|---|---|
| End of phase 1 | End of phase 2 | Strong liquor | Weak liquor | Start phase 1 | End phase 1 | Start phase 2 | End phase 2 |
| 55 | 47 | 59.0 | 43.0 | 19.2 | 68.7 | 48.2 | 63.5 |
| 54 | 47 | 59.1 | 39.9 | 19.2 | 70.7 | 46.0 | 59.0 |
| 53 | 47 | 59.2 | 37.1 | 19.2 | 72.6 | 43.9 | 54.8 |
| 52 | 47 | 59.3 | 34.1 | 19.3 | 74.6 | 41.7 | 50.4 |
| 51 | 47 | 59.4 | 31.3 | 19.3 | 76.4 | 39.6 | 46.3 |
| 50 | 47 | 59.5 | 30.0 | 19.3 | 77.3 | 38.6 | 44.3 |

The calculations are based on 1 metric ton wood. To phase 1 then are "charged" about 1 $m^3$ wood water, 1.4 $m^3$ white liquor (15% eff. NaOH calculated on the wood), and 1.3 $m^3$ strong liquor is recycled. A certain amount of white liquor (about 0.4 $m^3$) is charged in connection with the liquor exchange in order to cover the alkali demand during phase 2.

During section 1, of course, a great amount of lignin is solved the longer the cooking is going on (see Table 1). This will affect the lignin concentration in the liquor during phase 2. As discussed above, this is a critical parameter. As during phase 2, the lignin concentration is to be held low, and the exchange must take place at a relatively late phase of the cooking. At the same time, however, phase 2 must be sufficiently long so that the intended displacement of 3 by 4 (see FIG. 1) can be carried out properly. The cooking liquor exchange is calculated to require a time of 30 minutes. The cooking period during phase 2 is relatively short (about 30 minutes). On the basis of this consideration, a cooking liquor exchange at a yield of about 52% should be suitable (see Table 1). In this exchange, phase 2 has 41.7 g lignin/liter cooking liquor, and an extension of phase 1 to the yield 50% does not appreciably lower the lignin concentration during phase 2 (Table 1). Moreover, an extension of phase 1 to 50% yield would imply that phase 2 would be much too short from a cooking time aspect.

A review of the lignin concentration profile in Table 1 for the example with liquor exchange at 52% yield shows that, at the start of the cooking, the lignin concentration is 19.3 g/l. During section 1, it increases to 74.6 g/l when the displacement (exchange) is commenced. During phase 2, finally, we then have a mean concentration of about 45 g lignin/liter cooking liquor.

The alkali concentration does not vary during the cooking in an interval as great as during a normal batch cooking. The alkali concentration in the starting cooking liquor will be about 30 g/l (after initial consumption). During the main part of phase 1, the concentration will be between 10 and 15 g/l, with a residue alkali in the liquor exchange of about 6 g/l effective alkali. During section 2, the alkali concentration initially will be about 15 g/l, and the residue alkali at the end is about 6 g/l.

The third parameter of importance in extended cooking is the sulfide ion concentration and the sulfidity. In principle, one should try to obtain a sulfidity as high as possible. This means a level of preferably 40%, which today is a realistic sulfidity in a modern mill.

Two Liquor Exchanges

Figure 2:
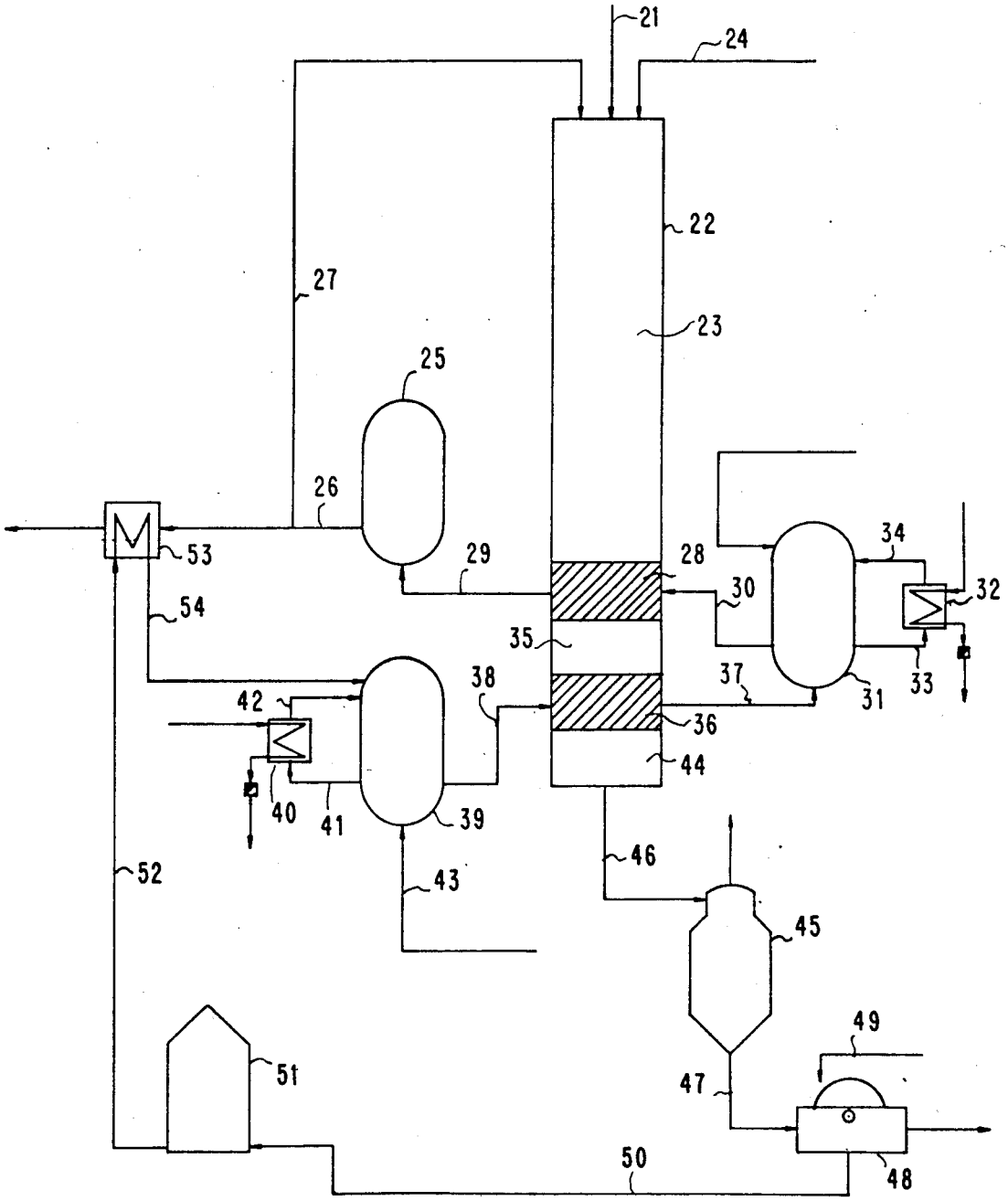
FIG. 2 is a block diagram of another embodiment of the present invention for batch cooking with two liquor exchanges.

Alternatively, a modified batch cooking with two liquor exchanges can be imagined as illustrated in FIG. 2 to provide increased selectivity in delignification. FIG. 2 thus illustrates by rectangular block diagrams different stages in the cooking cycle. Further, the liquor flows in the process and the suitable tanks are apparent from FIG. 2.

The system obtained is more complicated from a process-technical point of view. However, at the same time still lower lignin contents in the liquor can be held during the later part of the cooking than in the case of only one exchange. A much lower lignin content, above all, is obtained in phase 3. FIG. 2 illustrates this process according to a principle other than that in FIG. 1. The cooking process is illustrated by the rectangular process block, and delignification proceeds from above and downward in the block, with cooking phase 1, displacement 1, cooking phase 2, displacement 2 and, finally, cooking phase 3. The pulp is thereafter blown to blow tanks, from which it is taken to washing. The liquor movements between the different tanks and in the displacements also are apparent from the Figure.

Thus, as shown in FIG. 2 wood is introduced via line 21 into digester 22 wherein cooking phase 1 takes place in section 23. White liquor is introduced via line 24 and strong liquor (black liquor) is introduced from strong liquor accumulator 25 at 170° C. via lines 26 and 27. Strong liquor is displaced in section 28 and is passed via line 29 to the strong liquor accumulator 25. Into section 28 intermediate liquor is passed via line 30 from intermediate liquor accumulator 31 which is at 170° C. The intermediate liquor is treated by means of heat exchanger 32 and lines 33 and 34. Cooking phase 2 takes place in section 35 of the digester 22. In section 36 of the digester the intermediate cooking liquor is displaced via line 37 to the intermediate liquor accumulator 31. Weak liquor is introduced into section 36 via line 38 from weak liquid accumulator 39 which is at 170° C. The weak liquor is treated by means of heat exchanger 40 and lines 41 and 42. White liquor is added to the weak liquid accumulator via line 43. Cooking phase 3 takes place in section 44 of the digester 22. The pulp is thereafter blown to blow tanks 45 via line 46 from which the pulp is taken via line 47 to washing plant 48. Washing liquor is introduced into washing plane 48 via line 49 and the filtrate therefrom is passed via line 50 to the washing filtrate tank 51 which is at 90° C. This washing filtrate is passed from washing filtrate tank 51 via line 52 through heat exchanger 53 (where it is exchanged with the hot strong liquor and then via line 54 to the weak liquor accumulator 39.

The sulfidity should be as high as possible, proposedly 40%, exactly as in the case of one liquor exchange. Estimations of the lignin contents for this case are reported in Table 2.

TABLE 2

Calculated lignin concentrations in different phases of the cooking at modified batch cooking with two cooking liquor exchanges. The calculations are based on the same data as for Table 1.

| Yield (%) | | | Lignin concentrations (g/l) | | | | | |
|---|---|---|---|---|---|---|---|---|
| End of phase 1 | End of phase 2 | End of phase 3 | Strong liquor | Inter-mediate liquor | Weak liquor | During phase 1 | During phase 2 | During phase 3 |
| 58 | 52 | 47 | 59.3 | 52.0 | 32.9 | 21-64 | 50-62 | 36-43 |

The invention is not restricted to the embodiments shown, but can be varied within the scope of the invention idea.

We claim:

1. A method of making sulfate pulp with a high degree of delignification from lignocellulose material in a batch digester, said method comprising the steps of cooking said lignocellulose material in said batch digester at a digester temperature in a first cooking phase utilizing a cooking liquor containing white liquor and black liquor to provide a free liquor having a first lignin content; displacing substantially all of said free liquor after said first cooking phase with a displacement liquor having a lower lignin content than said first lignin content and having substantially the same temperature as said digester temperature; thereafter cooking said lignocellulose material in the presence of said displacement liquor in a second cooking phase to provide a free liquor having a second lignin content from said lignocellulose material, separating the pulp from said free liquor having said second lignin content by washing and filtering to provide a filtrate, adding white liquor to said filtrate to form a composition of liquor, and utilizing said composition of liquor as said displacement liquor, said method including only two cooking phases as aforesaid, said displacing step being carried out when the lignocellulose material has been cooked to a yield of between about 50% and 54% in said first cooking phase.

* * * * *